US009657533B2

(12) United States Patent
Greening et al.

(10) Patent No.: US 9,657,533 B2
(45) Date of Patent: May 23, 2017

(54) DRILLING COMPONENT RETENTION SYSTEM AND METHOD

(71) Applicant: Tesco Corporation, Houston, TX (US)

(72) Inventors: Doug Christian Greening, Calgary (CA); Ryan Thomas Bowley, Calgary (CA)

(73) Assignee: Tesco Corporation, Houston, TX (US)

( * ) Notice: Subject to any disclaimer, the term of this patent is extended or adjusted under 35 U.S.C. 154(b) by 288 days.

(21) Appl. No.: 14/448,577

(22) Filed: Jul. 31, 2014

(65) Prior Publication Data

US 2016/0032664 A1 Feb. 4, 2016

(51) Int. Cl.
*E21B 17/02* (2006.01)
*E21B 17/046* (2006.01)
*E21B 41/00* (2006.01)

(52) U.S. Cl.
CPC ..... *E21B 17/046* (2013.01); *E21B 41/0021* (2013.01)

(58) Field of Classification Search
CPC ..... E21B 19/16; E21B 17/046; E21B 33/038; E21B 17/043; E21B 17/06; E21B 17/042; E21B 17/02; F16L 21/06
See application file for complete search history.

(56) References Cited

U.S. PATENT DOCUMENTS 3,015,500 A 1/1962 Barnett
3,768,579 A * 10/1973 Klein ..... E21B 19/167 173/164
4,557,508 A 12/1985 Walker
4,981,180 A * 1/1991 Price ..... E21B 3/02 173/164
6,712,402 B2 3/2004 Winship
6,851,725 B2 2/2005 Lutzke
7,204,525 B2 4/2007 Matzner
7,618,069 B2 11/2009 Lutzke
7,779,922 B1 * 8/2010 Harris ..... E21B 17/046 166/379
8,091,930 B2 1/2012 Robichaux et al.
8,448,320 B2 * 5/2013 Yater ..... E21B 21/02 175/325.2
9,206,851 B2 * 12/2015 Slaughter, Jr. ..... F16D 1/033
2004/0118467 A1 6/2004 Pirart
2004/0194967 A1 * 10/2004 Jaensch ..... B25B 13/5016 166/380

(Continued)

FOREIGN PATENT DOCUMENTS

RU 1248507 12/1960
SU 1520291 11/1989

OTHER PUBLICATIONS

PCT/US2015/040639 Invitation to Pay Additional Fees mailed Nov. 20, 2015.

*Primary Examiner* — Kipp Wallace
(74) *Attorney, Agent, or Firm* — Fletcher Yoder, P.C.

(57) ABSTRACT

The present disclosure is directed to a system for retention of drilling components of a drilling rig that includes a first drilling component with a first retention feature, a second drilling component with a second retention feature, and a secondary retention device. The first drilling component is coupled to the second drilling component and the secondary retention device engages with the first retention feature of the first drilling component and with the second retention feature of the second drilling component.

17 Claims, 6 Drawing Sheets

(56) References Cited

U.S. PATENT DOCUMENTS

| | | | | |
|---|---|---|---|---|
| 2007/0074874 | A1 | 4/2007 | Richardson | |
| 2007/0131416 | A1* | 6/2007 | Odell | E21B 19/06 166/250.1 |
| 2008/0099221 | A1* | 5/2008 | Lynch | E21B 19/16 173/152 |
| 2010/0123308 | A1 | 5/2010 | Lowry | |
| 2012/0312550 | A1 | 12/2012 | Coeffe | |

* cited by examiner

DRILLING COMPONENT RETENTION SYSTEM AND METHOD

BACKGROUND

Embodiments of the present disclosure relate generally to the field of drilling and processing of wells. More particularly, present embodiments relate to a system and method for retention of components of a drilling rig.

During a drilling process via a drilling rig, a drill string or a tubular of the drill string may be supported and hoisted about the drilling rig by a hoisting system for eventual positioning of the drill string down hole in a well (e.g., a wellbore). As the drill string is lowered into the well, a drive system may rotate the drill string to facilitate drilling. Further, at the end of the drill string, a bottom hole assembly (BHA) and a drill bit may press into the ground to drill the wellbore.

The drill string may include multiple sections of tubular (e.g., drill pipe or collars) or other components, including coiled tubing, that are coupled to one another by threaded connections or tool joints to form the drill string. The drill string and joints of the drill string may frictionally engage edges of the wellbore. Further, the drill string and joints may be axially and torsionally loaded due to the drilling process. In some instances, the joint between two sections of axially adjacent tubular (e.g., drill pipe or collars) or the joint between two other drilling rig components may fail. Accordingly, it is now recognized that improved retention (or, in other words, a secondary method of retention) between components of a drilling rig is desired. For example, secondary retention may avoid decoupling of a portion of a drill string, which prevents complications such as the drill string falling into the wellbore.

BRIEF DESCRIPTION

In a first embodiment, a system for retention of components of a drilling rig includes a first drilling component with a first retention feature, a second drilling component with a second retention feature, and a secondary retention device. The first drilling component is coupled to the second drilling component and the secondary retention device engages with the first retention feature of the first drilling component and the second retention feature of the second drilling component.

In a second embodiment, a secondary retention device for use in a drilling rig includes a first retention feature, a second retention feature, and a body extending between the first retention feature and the second retention feature. A first drilling component of the drilling rig is coupled to a second drilling component of the drilling rig via a threaded connection. The first retention feature of the secondary retention device is configure to engage with the first drilling component and the second retention feature of the secondary retention device is configured to engage with the second drilling component. Further, the body of the secondary retention device is configured to fit over and around the threaded connection between the first drilling component and the second drilling component.

In a third embodiment, a method of secondary retention of two drilling components on a drilling rig includes coupling a first drilling component of the drilling rig with a second drilling component of the drilling rig via a connection, fitting a retaining device around the connection, engaging a first device feature of the retaining device with a first retention feature of the first drilling component above the connection, and engaging a second device feature of the retaining device with a second retention feature of the second drilling component below the connection.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
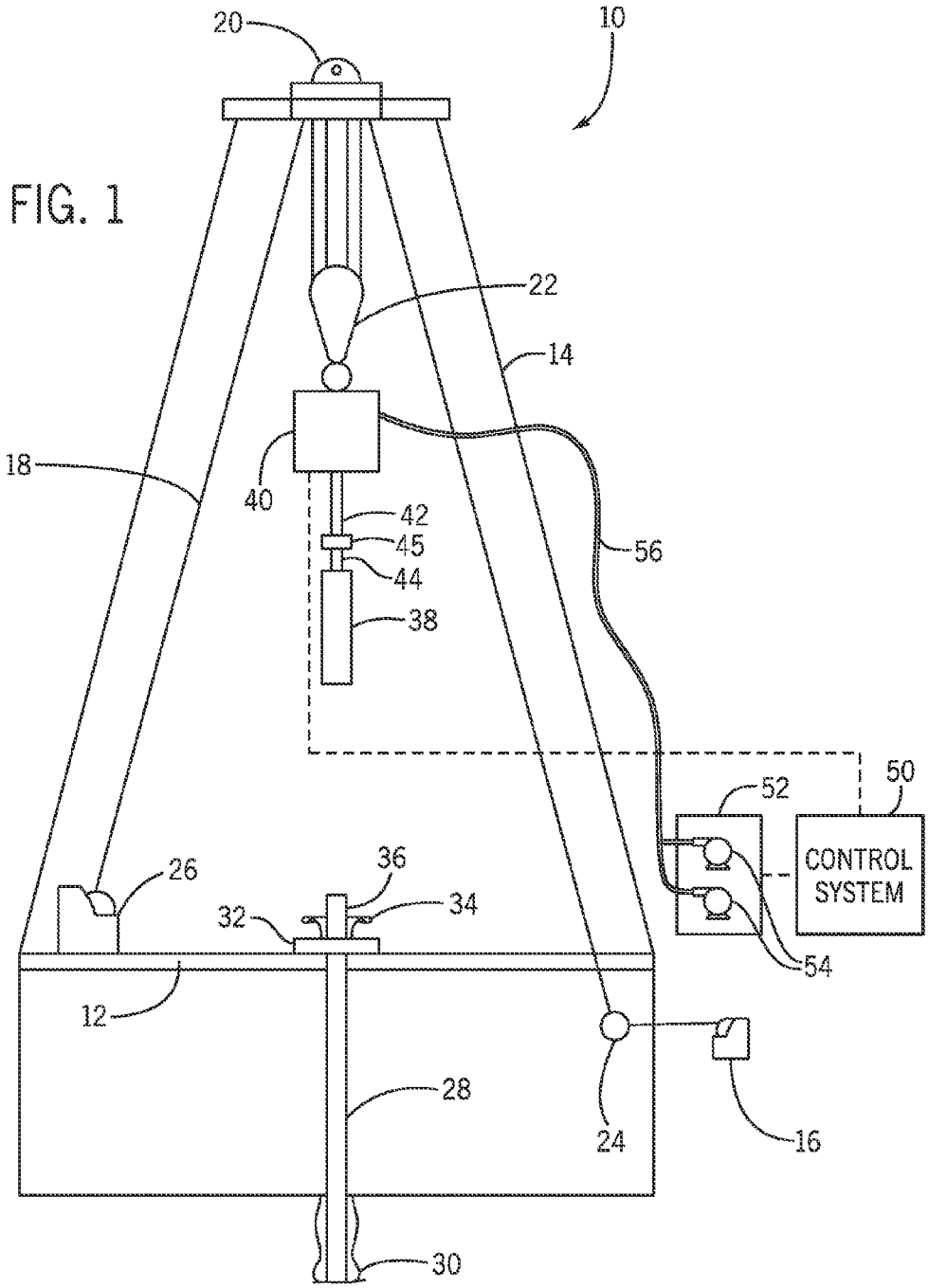
FIG. 1 is a schematic of a drilling rig in the process of drilling a well in accordance with present embodiments.

Various drilling techniques can be utilized in accordance with embodiments of the present disclosure. In conventional oil and gas operations, a well is typically drilled to a desired depth with a drill string, which includes tubular (e.g., drill pipe or collars) and a drilling bottom hole assembly (BHA). During a drilling process, the drill string or a portion of the drill string (e.g., a tubular of the drill string) may be supported and hoisted about a drilling rig by a hoisting system for eventual positioning down hole in the well. As the drill string is lowered into the well, a drive system may rotate the drill string to facilitate drilling. A drive system typically includes a rotational feature (e.g., a drive shaft or quill) that transfers torque to the drill string from a top drive or the like. For example, the top drive may generate torque and utilize the quill to transfer the torque to the drill string, in some embodiments through a saver sub disposed between the quill and the drill string. The saver sub is a piece of tubular threaded to the quill which serves, in some embodiments, as a sacrificial component such that the threads of the quill do not constantly wear out. Further, saver subs are generally less likely to fatigue because they are subject to replacement more regularly than the quill.

Top drives, which may generate the torque or rotation transferred to the drill string via the quill and, in some embodiments, the saver sub, are typically utilized in well drilling and maintenance operations, such as operations related to oil and gas exploration. The drill string may include multiple sections of tubular, including coiled tubing, that are coupled to one another by threaded connections or tool joints. However, the drilling rig may also include other threaded connections or tool joints (e.g., between the quill and the saver sub, as described above). The joints of the drilling rig (e.g., between the quill and the saver sub, between two sections of axially adjacent tubular, or between other drilling components) may frictionally engage edges of the wellbore, may experience torsional loading transferred from the top drive through the drill string, and may, in some embodiments, experience axial loading from the weight of the drill string above and/or below the threaded connections (e.g., joints), which may fatigue the joints.

Connections (e.g., threaded joints) between drilling components of the drilling rig may fail during or after operation. For example, the threaded connection between the quill and the saver sub, which is disposed between the quill and a piece of tubular below the saver sub, may wear or fatigue. In particular, the threads of the quill-saver sub connection may fail. Without secondary retention, failure of a joint between two sections of tubular or any other components of the drilling rig (e.g., between the saver sub and the quill) may result in the drill string or other components below the failed joint falling away from the joint. In some instances, the drill string or tubular may fall away from the joint and into the well. In accordance with present embodiments, a secondary retention device may be placed over the threaded connection between the two drilling components (and, depending on the embodiment, over a die lock of the threaded connection), where the secondary retention device engages with retention features on either side of the threaded connection (e.g., retention features of the quill and of the saver sub), such that the drilling components on either side of the failed threaded connection or joint remain at least partially engaged via the secondary retention device. In some embodiments, the secondary retention device may slackingly engage with the retention features in the axial direction, such that the secondary retention device does not bear axial load from the drill string during normal operating conditions. In other words, an intact threaded joint between the two sections of tubular, or some other axial load bearing device, may handle axial loading during normal drilling conditions, while the secondary retention device slackingly engages with the retention features of both sets of tubular. Thus, during normal operation, an intact primary connection between drilling components (e.g., threaded pipe sections) will block a substantial axial load (e.g., a majority of the axial load) resulting from drilling components from being placed on the secondary retention device. In the event the threaded connection fails, the drill string or tubular (and/or saver sub) below the threaded connection may separate from the threaded connection slightly, such that the secondary retention device disposed around the threaded connection engages with the retention features. Accordingly, the secondary retention device is axially loaded and supports the weight of the drill string or drilling component below the threaded connection, holding the two components together.

It should be noted that the secondary retention device may, in some embodiments, be referred to as a drilling clamp, a drilling component clamp, a retention clamp, or a clamp. However, one of ordinary skill in the art will appreciate that secondary retention devices, in accordance with the present disclosure, may, in some embodiments, only slackingly engage with the drill string during normal operation. Accordingly, the secondary retention device may not actually clamp drilling components together unless the threaded connection between the drilling components fails. For example, if the threaded connection fails, the two drilling components on either side of the threaded connection may separate until the secondary retention device engages with retention features in both of the drilling components, thus axially clamping the two components until the failed threaded connection is addressed. Accordingly, in some embodiments, the secondary retention device may temporarily act as an axial clamp for the two drilling components if the threaded connection between the two drilling components fails. The secondary retention device will be described in detail with reference to the figures below.

Turning now to the figures, FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another length of tubular 38 may be added. The drill string 28 may include multiple sections of threaded tubular 38 that are threadably coupled together. It should be noted that present embodiments may be utilized with drill pipe, casing, or other types of tubular, as well as with other threadably engaged components of the drilling rig 10.

During operation, a top drive 40, hoisted by the traveling block 22, may engage and position the tubular 38 above the wellbore 30. The top drive 40 may then lower the coupled tubular 38 into engagement with the stump 36 and rotate the tubular 38 such that it connects with the stump 36 and becomes part of the drill string 28. Specifically, the top drive 40 includes a quill 42 to turn the tubular 38 or other drilling equipment. After setting or landing the drill string 28 in place such that the male threads of one section (e.g., one or more joints) of the tubular 38 and the female threads of another section of the tubular 38 are engaged, the two sections of the tubular 38 may be joined by rotating one section relative to the other section (e.g., in a clockwise direction) such that the threaded portions tighten together. Thus, the two sections of tubular 38 may be threadably joined.

Other portions of the drilling rig 10 may also be threadably joined. For example, the quill 42 may be coupled to a saver sub 44 and the saver sub 44 may be coupled to the tubular 38, such that torque is transmitted from the top drive 40 through the quill 42 and through the saver sub 44 to the tubular 38 for engaging the tubular 38 with the drill string 28. The saver sub 44 is included between the quill 42 and the tubular 38 to preserve the integrity of the threads on the quill 42. This generally makes the threads of the saver sub 44 coupled to the tubular 38 more likely to fail than the threads of the quill 42. In the illustrated embodiment, the quill 42 and saver sub 44 are further joined via a drilling component secondary retention device 45 (e.g., a secondary retention device), in accordance with embodiments of the present disclosure. The secondary retention device 45 may be configured to engage with retention features disposed on both the quill 42 and the saver sub 44. Accordingly, in the event the tubular 38 and the saver sub 44 coupled to the tubular 38 break away from the quill 42 at the threaded connection between the saver sub 44 and the quill 42, the secondary retention device 45 will hold the quill 42 and the saver sub 44 together and block the tubular 38 and saver sub 44 from falling, e.g., down the wellbore 30. In other words, the secondary retention device 45 may bear an axial load of the drill string 28 after the threaded connection fails. In other embodiments, the secondary retention device 45 may be included over any threaded connection of any components of the drilling rig 10, so long as the components engaged (e.g., threadably engaged) with each other include retention features for the secondary retention device 45 to fit over.

During other phases of operation of the drilling rig 10, the top drive 40 may be utilized to disconnect and remove sections of the tubular 38 from the drill string 28, as is illustrated in FIG. 1. As the drill string 28 is removed from the wellbore 30, the sections of the tubular 38 may be detached by disengaging the corresponding male and female threads of the respective sections of the tubular 38 via rotation of one section relative to the other in a direction opposite that used for coupling.

While FIG. 1 illustrates the drilling rig 10 in the process of adding the tubular 38 to the drill string 28, as would be expected, the drilling rig 10 also functions to drill the wellbore 30. Indeed, the drilling rig 10 includes a drilling control system 50 in accordance with the present disclosure. The control system 50 may coordinate with certain aspects of the drilling rig 10 to perform certain drilling techniques. For example, the drilling control system 50 may control and coordinate rotation of the drill string 28 via the top drive 40 and supply of drilling mud to the wellbore 30 via a pumping system 52. The pumping system 52 includes a pump or pumps 54 and conduits or tubing 56, which may include connection features such as a goose neck of the top drive 40. The pumps 54 are configured to pump drilling fluid down hole via the tubing 56, which communicatively couples the pumps 52 to the wellbore 30. In the illustrated embodiment, the pumps 54 and tubing 56 are configured to deliver drilling mud to the wellbore 30 via the top drive 40. Specifically, the pumps 54 deliver the drilling mud to the top drive 40 via the tubing 56, the top drive 40 delivers the drilling mud into the drill string 28 via a passage through the quill 42, and the drill string 28 delivers the drilling mud to the wellbore 30 when properly engaged in the wellbore 30. The mud may be routed through the drill string 28 and out of the drill string 28 into an area between the drill string 28 and the sides of the well 30. Thus, the mud may reduce frictional engagement of the drill string 28 with the sides of the well 30, which is also addressed via rotation of the drill string 28 from the top drive 40, as previously described. In other words, the control system 50 may control rotation of the drill string 28 and supply of the drilling mud by controlling operational characteristics of the top drive 40 and pumping system 52 based on inputs received from sensors and manual inputs.

Figure 2:
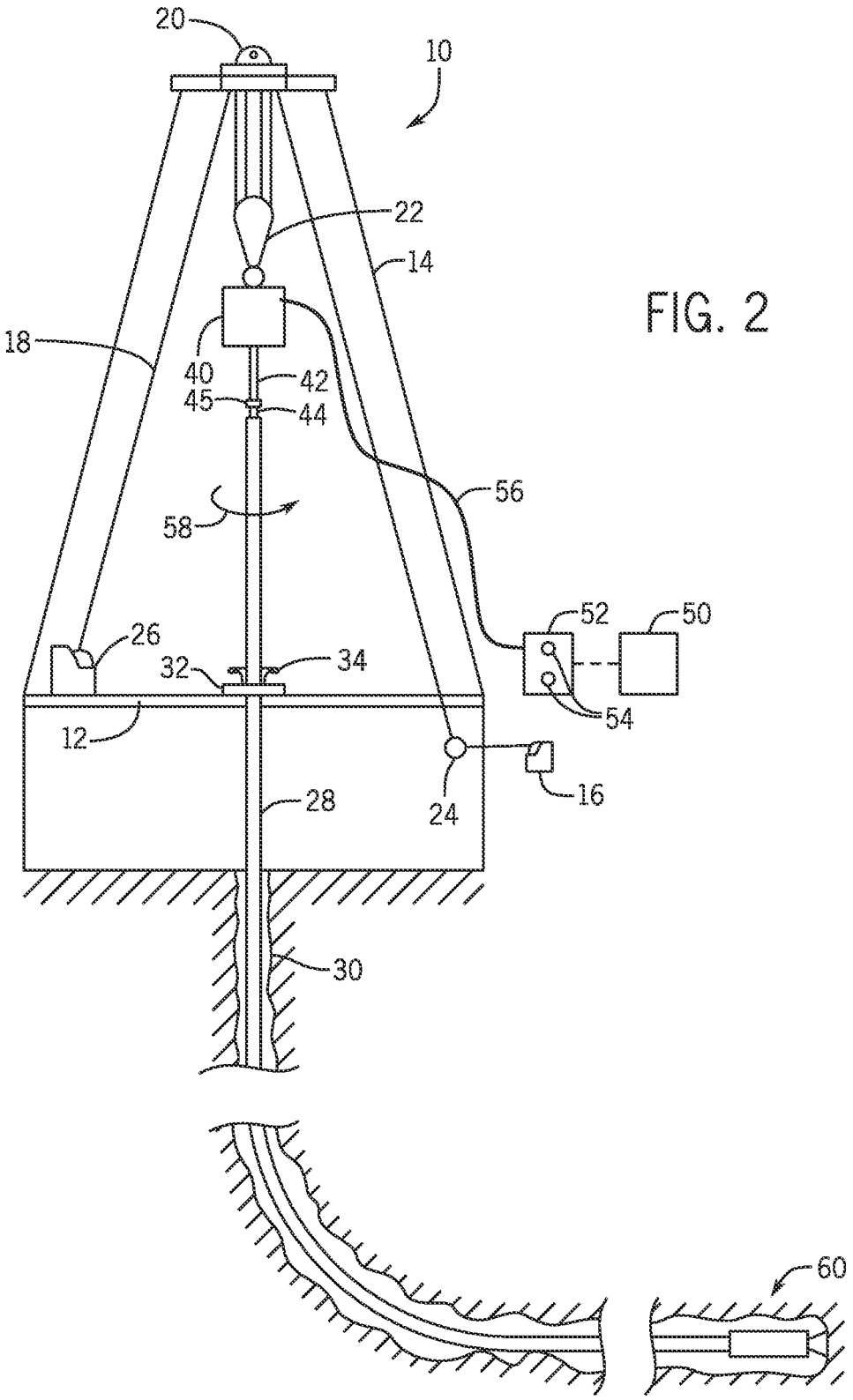
FIG. 2 is a schematic of a drilling rig in the process of directional drilling in accordance with present embodiments.

FIG. 2 is a schematic representation of the drilling rig 10 during a directional drilling operation. In the illustrated embodiment, the top drive 40 is utilized to transfer rotary motion to the drill string 28 via the quill 42 (and saver sub 44), as indicated by arrow 58. In other embodiments, different drive systems (e.g., a rotary table, coiled tubing system, downhole motor) may be utilized to rotate the drill string 28 (or vibrate the drill string 28). Where appropriate, such drive systems may be used in place of the top drive 40. It should be noted that the illustrations of FIGS. 1 and 2 are intentionally simplified to focus on particular features of the drilling rig 10. Many other components and tools may be employed during the various periods of formation and preparation of the well. Similarly, as will be appreciated by those skilled in the art, the orientation and environment of the well may vary widely depending upon the location and situation of the formations of interest. For example, the well, in practice, may include one or more deviations, including angled and horizontal runs. Similarly, while shown as a surface (land-based) operation, the well may be formed in water of various depths, in which case the topside equipment may include an anchored or floating platform.

As illustrated in FIG. 2, the top drive 40 is utilized at least in part to rotate the drill string 28. As noted above, the drill string 28 may frictionally engage with sides of the wellbore 30. Further, the drill string 28 and threaded connections between separate pipes (e.g., tubulars) of the drill string 28 may experience torsional loading from the top drive 40 and/or a drill bit 60 disposed at an end of the drill string 28 opposite the top drive 40, and axial loading from the weight of the drill string 28 (e.g., tubular of the drill string 28) and other components of the drilling rig 10. Accordingly, the secondary retention device 45, in accordance with the present disclosure, may be placed around any connection between two components of the drill rig 10 that engage, providing secondary retention of the two components in the event the primary connection (e.g., a threaded connection) fails and the lower of the components (e.g., below the connection) separates from the connection. For example, in the illustrated embodiment, the secondary retention device 45 is placed over the threaded connection between the quill 42 and the saver sub 44. In the event the threaded connection between the quill 42 and the saver sub 44 fails, the secondary retention device 45 may block the drill string 28 (and the saver sub 44) from falling away from the quill 42.

Figure 3:
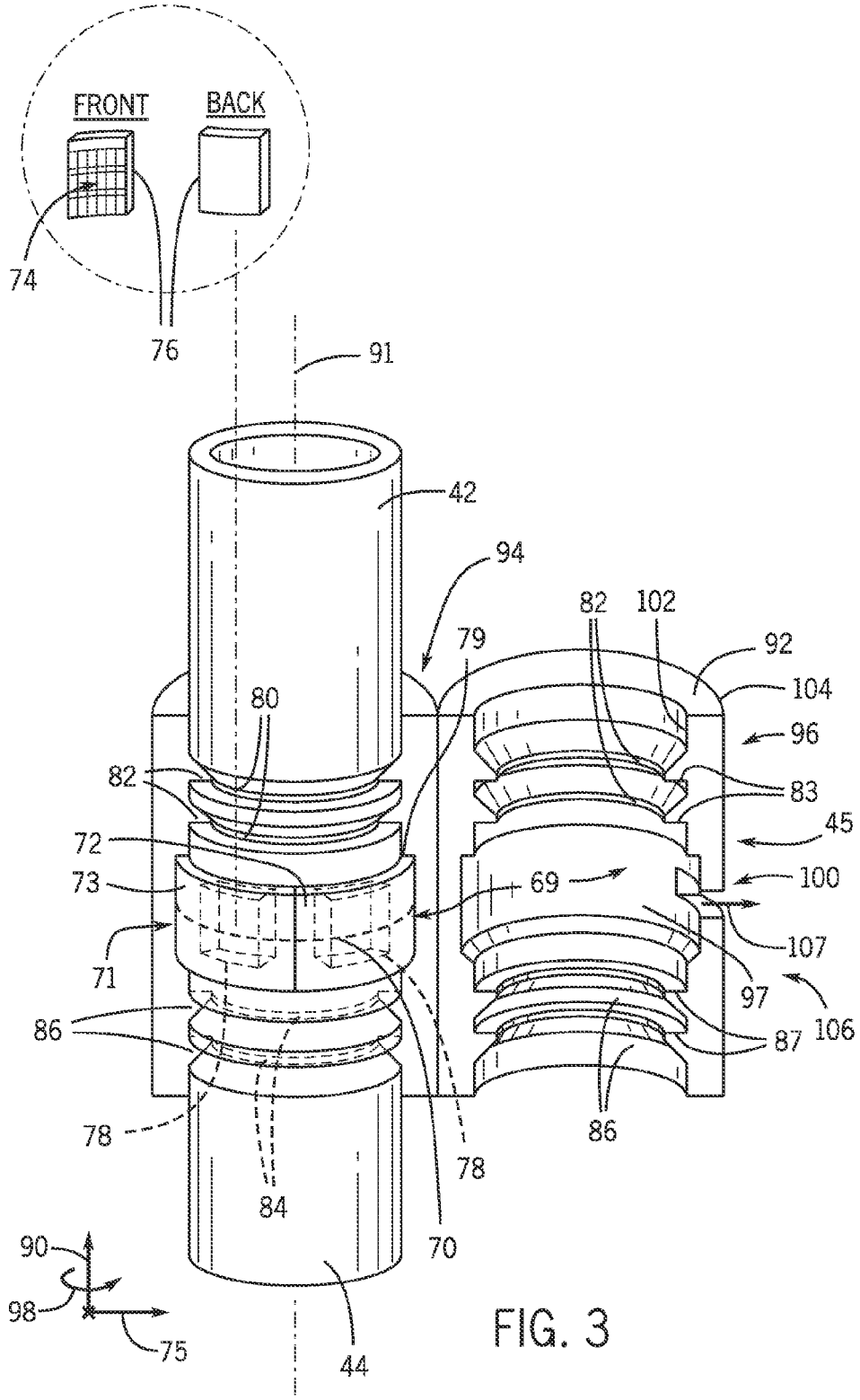
FIG. 3 is a cutaway perspective view of a threaded connection and retaining device of a drilling rig in accordance with present embodiments.

FIG. 3 is a cutaway perspective view of an embodiment of the quill 42 and the saver sub 44 with the secondary retention device 45 disposed around a threaded connection 70 between the quill 42 and the saver sub 44. The secondary retention device 45 is shown as two pieces, where one of the pieces is opened to show internal features of the secondary retention device 45 and other features proximate the secondary retention device 45, for example, features of the saver sub 44 and the quill 42. In another embodiment, the secondary retention device 45 may fit around a threaded connection between other components of the drilling rig 10 besides the quill 42 and the saver sub 44, for example, two axially adjacent sections of tubular 38 of the drill string 28. Accordingly, the illustrated embodiment is intended to be a non-limiting example of one set of components for which the secondary retention device 45 may be used as a secondary retention device.

In the illustrated embodiment, the quill 42 includes a male thread and the saver sub 44 includes a female thread. Alternatively, the quill 42 may include a female thread and the saver sub 44 may include a male thread. In addition to the secondary retention device 45 fitting around the illustrated threaded connection 70, which will be discussed in detail below, a die lock 71 may also fit around the threaded connection 70, radially inward from the secondary retention device 45. In other words, the die lock 71 may fit radially between the threaded connection 70 and the secondary retention device 45 in a recess 69 of the secondary retention device 45.

The die lock 71 may include two pieces 72, 73 configured to extend annularly around the threaded connection 70, where each of the two pieces 72, 73 is approximately 180 degrees in circumference. Further, the die lock 71 includes vertical grooves or extensions 74 disposed on various dies 76 that fit into the die lock 71, where the dies 76 are disposed in the die lock 71 such that the dies 76 may engage with the quill 42 and the saver sub 44. To secure the die lock 71 around the threaded connection 70, the two pieces 72, 73 of the die lock 71 may be pressed against the threaded connection 70 (or, more accurately, above and below the threaded connection 70 against the saver sub 44 and quill 42) such that the vertical grooves or extension 74 of the dies 76 disposed in the die lock 71 engage with both the saver sub 44 and the quill 42 on either side of the threaded connection 70. The two pieces 72, 73 of the die lock 71 may be clamped together via bolts, which will be described below with reference to later figures. Alternatively, the two pieces 72, 73 of the die lock 71 may be held together via the secondary retention device 45 disposed around the two pieces 72, 73. Indeed, in some embodiments, the die lock 71 may be clamped about the threaded connection 70 such that the extensions 74 (e.g., teeth) of the dies 76 impinge the quill 42 and the saver sub 44 to an extent, increasing a force between the dies 76 and the saver sub 44 and quill 42 on either side of the threaded connection 70. Accordingly, the die lock 71 may transfer torque from the quill 42 to the saver sub 44 via the vertical grooves or extensions 74 (e.g., teeth) during normal operation. In other embodiments, different types of engagement techniques may be employed. For example, the various dies 76 may have a rough surface that does not necessarily include vertical grooves. Further, in some embodiments, the die lock 71 may be at least partially integrated with the secondary retention device 45. For example, the secondary retention device 45 may directly receive the various dies 76. Further still, in some embodiments, a spline lock may be used instead of the die lock 71. The spline lock will be described with reference to later figures.

In the illustrated embodiment, the vertical grooves or extensions 74 (e.g., teeth) are disposed on the dies 76, which fit into slots 78 through a top 79 of the die lock 71. The dies 76 may be disposed in the slots 78 before clamping the die lock 71 into position. For clarity, both sides of one of the dies 76 are shown with the die 76 outside of the slot 78. As illustrated, the die 76 includes vertical grooves or extensions 74 (e.g., teeth). The slots 78 are disposed such that the inside of the slots 78 are exposed to the outer surface of the quill 42 and the outer surface of the saver sub 44. As such, the vertical extensions or teeth 74 of the dies 76 may face the quill 42 and saver sub 44 and interface with the saver sub 44 and the quill 42. Accordingly, the die lock 71 may be fitted around the quill 42 and the saver sub 44, or any other two threadably engaged components of the drilling rig 10, after the dies 76 are disposed into the slots 78 of the die lock 71. Thus, when the quill 42 rotates, the vertical grooves or extensions 74 on the die lock 71, and the vertical grooves or extensions 74 on the die lock 71, which are engaged with outer surfaces of the quill 42 and the saver sub 44, may engage such that torque is transferred through the die lock 71 from the quill 42 to the saver sub 44. Accordingly, the die lock 71 may reduce a likelihood that the threaded connection 70 fails due to torsional loading by absorbing some or all of the torsional load. Further, the removable dies 76 are included such that, when the vertical grooves or extensions 74 on the dies 76 wear, the dies 76 may be easily replaced as opposed to replacing the entire die lock 71. In this way, the dies 76 may be replaced instead of replacing the quill 42 and/or the saver sub 44, which may be larger, more expensive, and more difficult to replace. In other words, the dies 76 may be a sacrificial component for reducing wear on the threaded connection 70 between the quill 42 and the saver sub 44 (or any two threadably engaged drilling components).

It should be noted that the terms "grooves" and "extensions" may be used interchangeably in the present disclosure, but that "grooves" may technically refer to inward recesses from an engaging surface of one component and "extensions" may technically refer to outward protrusions from an engaging surface of another component. In other words, extensions of a first component may extend from a first engaging surface of the first component beyond a second engaging surface of a second component into grooves of the second component, where the grooves of the second component recess into the second component beyond the second engaging surface of the second component.

Continuing with the illustrated embodiment, in some instances, the threaded connection 70 may still be susceptible to failure. For example, the threaded connection 70 between the quill 42 and the saver sub 44 may fatigue over time, due to axial and/or torsional loading, such that the threaded connection 70 (e.g., male/female threads of the threaded connection 70) between the quill 42 and the saver sub 44 wears away. In accordance with the present disclosure, the secondary retention device 45 is disposed around the threaded connection 70 and the die lock 71 to enable secondary retention of the quill 42 and the saver sub 44 in the event the threaded connection 70 between the quill 42 and the saver sub 44 fails. In general, the secondary retention device 45 is only intended to carry an axial load of the drill string 28 in the event the threaded connection 70 breaks, although the secondary retention device 45 may also transfer a certain amount of torque from the quill 42 to the saver sub 44 during normal operation. For example, the die lock 71 described above may actually be an integral component of the secondary retention device 45, or may interface with or couple to the secondary retention device 45, such that the secondary retention device 45 transfers a portion of the torque from the quill 42 to the saver sub 44 as the quill 42 rotates.

In the illustrated embodiment, the quill 42 includes substantially horizontal grooves 80 (e.g., retention features) above the threaded connection 70, where the grooves 80 are configured to interface with upper extensions 82 (e.g., retention features) of the secondary retention device 45, where the upper extensions 82 include lower faces 83. The lower faces 83 may be substantially parallel with direction 75 (e.g., perpendicular to direction 90). Additionally, the saver sub 44 includes substantially horizontal grooves 84 (e.g., retention features) below the threaded connection 70, where the grooves 84 of the saver sub 44 are configured to interface with lower extensions 86 (e.g., retention features) of the secondary retention device 45, where the lower extensions 86 include upper faces 87. The upper faces 87 may be substantially parallel with direction 75 (e.g., perpendicular to direction 90), such that the upper faces 87 and lower faces 83 are all parallel with direction 75 and the upper extensions 82 and lower extensions 86 are substantially mirrored across the threaded connection 70. In some embodiments, the upper faces 87 and the lower faces 83 may not be parallel with the threaded connection 70, but may be otherwise angled to enable secondary retention of the two drilling components, as will be described in detail below.

A body 97 of the secondary retention device 45 extends between the upper extensions 82 (e.g., retention features) and the lower extensions 86 (e.g., retention features) of the secondary retention device 45. In another embodiment, the quill 42 may include extensions which interface with upper grooves of the secondary retention device 45 and the saver sub 44 may include extensions which interface with lower grooves of the secondary retention device 45. In either configuration, the secondary retention device 45 interfaces with both the quill 42 and the saver sub 44 at locations axially outside of the threaded connection 70 (e.g., in axial direction 90 parallel to a longitudinal axis 91 extending through the drill string 28). Accordingly, if the threaded connection 70 between the quill 42 and the saver sub 44 fails, any axial loads of the drill string 28 or any other component(s) of the drilling rig 10 may be supported via the secondary retention device 45, such that the saver sub 44 and any other component(s) of the drilling rig 10 (e.g., the drill string) do not fall away from the threaded connection 70.

In some embodiments, the upper and lower extension 82, 86 of the secondary retention device 45 may slackingly engage with the grooves 80 of the quill 42 and the grooves 84 of the saver sub 44 when the threaded connection 70 is intact, such that the threaded connection 70 (or some other component), not the secondary retention device 45, bears the axial load of the drill string 28 during normal operation, if any is present. In such an embodiment, in the event the threaded connection 70 between the quill 42 and the saver sub 44 fails, the saver sub 44 may fall slightly away from the threaded connection 70 until the upper and lower extension 82, 86 of the secondary retention device 45 fully engage with the grooves 80, 84 of the quill 42 and the saver sub 44, respectively. By including upper and lower extensions 82, 86 that are mirrored across the threaded connection 70 and by including lower and upper faces 83, 87 that are parallel with direction 75 (e.g., perpendicular to the direction 90 the two drilling components would separate in the event of a failure of the threaded connection 70), the lower and upper faces 83, 87 of the secondary retention device 45 may bear the axial load of the drill string 28. However, in some embodiments, the lower and upper faces 83, 87 may be angled to an extent, with respect to direction 75, and still function in a similar manner.

Further, it should be noted that the die lock 71, in some embodiments, may be integral with the secondary retention device 45 or a part of the secondary retention device 45 (e.g., as one piece or coupled together via adhesive, weld, etc.), such that the secondary retention device 45 itself transfers torque between two drilling components. Accordingly, the slots 78 of the die lock 71 portion of the secondary retention device 45 may extend upwards in the axial direction 90 through the secondary retention device 45 to a top 92 of the secondary retention device 45, such that the dies 76 of the die lock 71 may be inserted into the slots 78 from above the secondary retention device 45 before engaging the secondary retention device 45 around the threaded connection 70, as will be described in detail below. Alternatively, the secondary retention device 45 may include an internal feature, such as a cavity, for housing the die lock 71. For example, in the illustrated embodiment, the secondary retention device 45 includes a first piece 94 and a second piece 96, where the first and second pieces 94, 96 each are designed to extend 180 degrees circumferentially (e.g., in circumferential direction 98) around the threaded connection 70 of the quill 42 and the saver sub 44, much like the die lock 71. In some embodiments, both pieces 94, 96 may include a cavity that substantially conforms to the shape and size of the die lock 71. Accordingly, the quill 42 may be threadably engaged with the saver sub 44 via the threaded connection 70, the dies 76 may be slipped into the slots 78 of the die lock 71, the two pieces 72, 73 of the die lock 71 may be fitted around the threaded connection 70 such that the vertical grooves or extensions 74 of the dies 76 engage with the quill 42 and the saver sub 44, the two pieces 72, 73 of the die lock 71 may be secured together (e.g., via fasteners), and the two pieces 94, 96 of the secondary retention device 45 may be fitted around the die lock 71. The two pieces 94, 96 of the secondary retention device 45 may be coupled together via fasteners, welding, adhesives, or some other coupling device, as described in detail with reference to later figures.

In addition to the features described above, the secondary retention device 45 may also include a vent 100 that extends radially (e.g., in radial direction 75) from an inner wall 102 of the secondary retention device 45 to an outer wall 104 of the secondary retention device 45. In other words, the vent 100 may extend between area 106 external to the secondary retention device 45 and an area radially inward from the secondary retention device 45. In the event the threaded connection 70 between the quill 42 and the saver sub 44 fails, mud 107 flowing through the drill string 28 may escape through the failed threaded connection 70 into the secondary retention device 45. Further, the mud 107 may escape from an area radially (in radial direction 75) between the threaded connection 70 and the secondary retention device 45 to the area 106 outside of the secondary retention device 45 via the vent 100. Thus, the mud 107 may be observed escaping the vent 100 by an operator or the mud may be detected by a sensor, which may indicate that the threaded connection 70 has failed even though the threaded connection 70 is not visible from the area 106 external to the secondary retention device 45. In other words, the secondary retention device 45 not only serves as a secondary retention device of the quill 42 and the saver sub 44 by bearing an axial load of the drill string 28 in the event the threaded connection 70 fails, it also enables operators or sensors (e.g., which may communicate with the control system 50 in FIGS. 1 and 2) to determine if and when the threaded connection 70 fails.

Figure 4:
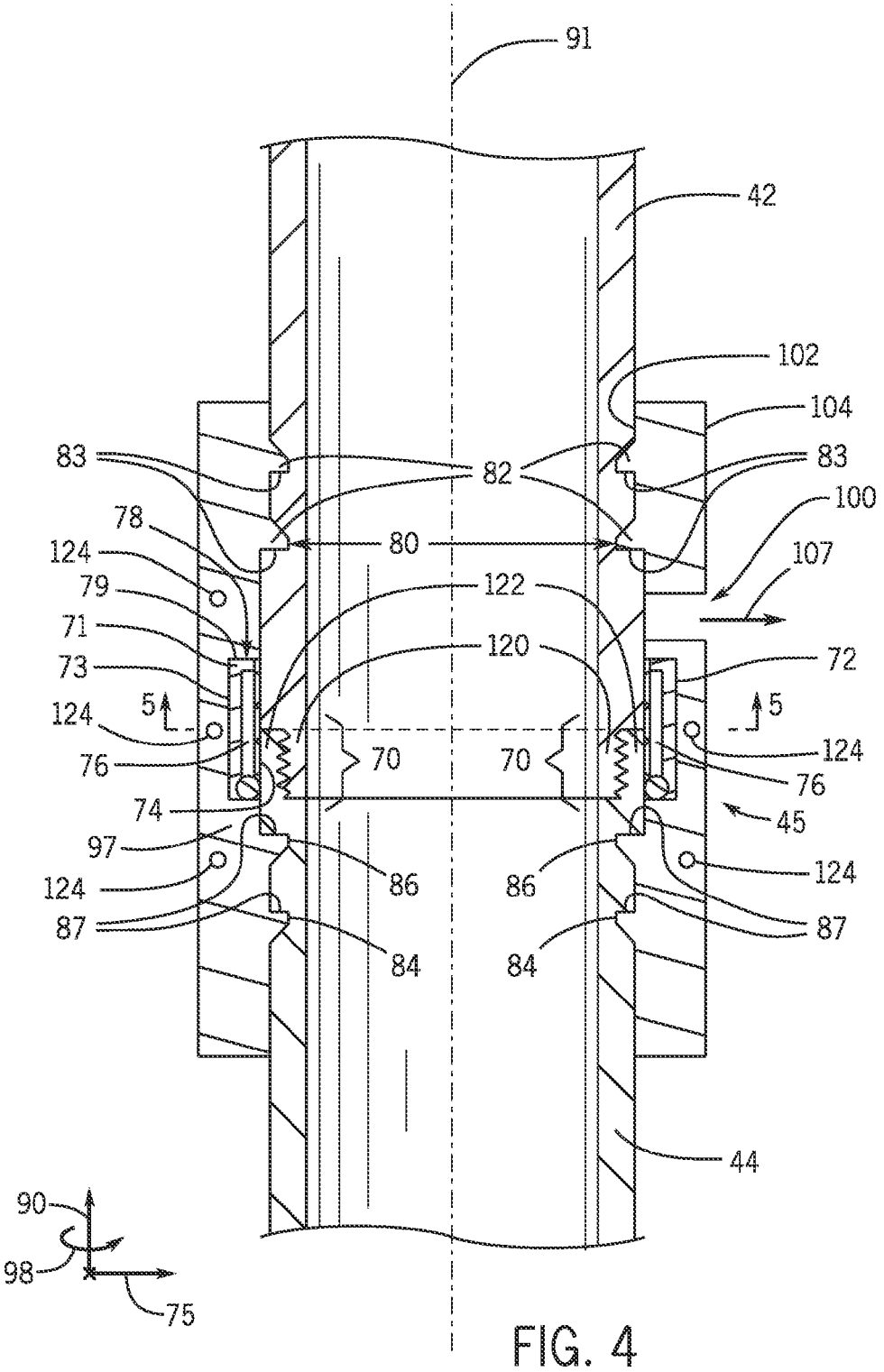
FIG. 4 is a cross-sectional side view of the threaded connection and retaining device of FIG. 3 in accordance with present embodiments.

Turning now to FIG. 4, a cross-sectional side view of an embodiment of the secondary retention device 45 is shown. In the illustrated embodiment, the quill 42 extends annularly 98 around the longitudinal axis 91 and includes a male thread 120 and the saver sub 45 includes a female thread 122. Together, the male thread 120 and the female thread 122 form the threaded connection 70 between the quill 42 and the saver sub 44.

As previously described, the die lock 71 is disposed around the threaded connection 70 between the quill 42 and the saver sub 44, and dies 76 of the die lock 71 engage with both the saver sub 44 and the quill 42. Accordingly, the vertical grooves or extensions 74 of the dies 76 interface with the quill 42 and the saver sub 44 such that rotation of the quill 42 transfers torque through the die lock 71 to the saver sub 44 and rotates the saver sub 44.

In addition to the die lock 71, the secondary retention device 45 is also disposed annularly 98 around the threaded connection 70. In the illustrated embodiment, the die lock 71 is a separate component from the secondary retention device 45, and fits into a cavity of the secondary retention device 45, as previously described (e.g., cavity 69 in FIG. 3). The two pieces 94, 96 (only one shown due to cross section) of the secondary retention device 45 are coupled together via fasteners 124, but may be coupled via some other coupling mechanism (e.g., welding or adhesive). In another embodiment, the die lock 71 may be integral with the secondary retention device 45, such that the secondary retention device 45 transfers torque from the quill 42 to the saver sub 44. It should be noted that, in embodiments where the die lock 71 is a separate component from the secondary retention device 45, the secondary retention device 45 may still transfer a portion of the torque from the quill 42 to the saver sub 44. For example, the die lock 71 may interface with the secondary retention device 45, such that turning the die lock 42 via rotation of the quill 42 also turns the secondary retention device 45 about the longitudinal axis 91 in circumferential direction 98. However, in some embodiments, the secondary retention device 45 may not substantially interface with the die lock 71. In such embodiments, the secondary retention device 45 may or may not turn with the die lock 71 as rotation is transferred from the quill 42, through the die lock 71, and to the saver sub 44, as previously described.

In the illustrated embodiment, the upper extensions 82 of the secondary retention device 45 fit into the grooves 80 of the quill 42, and the lower extensions 86 of the secondary retention device 45 fit into the grooves 84 of the saver sub 44. The extensions 82, 86 are shown as slackingly engaging with the grooves 80, 84, such that the secondary retention device 45 does not bear axial load of the weight of the drill string 28 below the threaded connection 70. If the threaded connection 70 fails for any reason, the saver sub 44 moves away from the threaded connection 70 slightly, until the extensions 82, 86 of the secondary retention device 45 fully engage with the grooves 80, 84, respectively, such that the secondary retention device 45 bears the axial load of the weight of the drill string 28 below the failed threaded connection 70.

Figure 5:
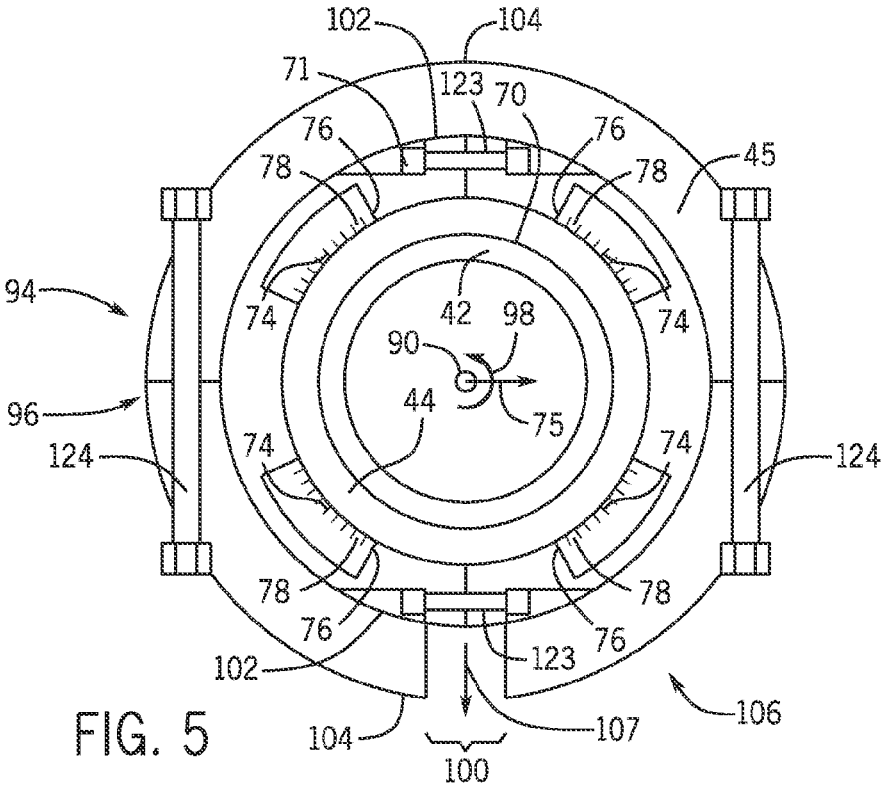
FIG. 5 is a cross-sectional top view of the threaded connection and retaining device of FIG. 3 in accordance with present embodiments.

A cross-sectional top view of an embodiment of the secondary retention device 45 is shown in FIG. 5. In the illustrated embodiment, the threaded connection 70 between male threads of the quill 42 and female threads of the saver sub 44 is shown. Thus, the quill 42 is shown radially inward from the saver sub 44, as the cross section cuts through the threaded connection 70. Radially outward from the quill 42 and the saver sub 44 is the die lock 71, which includes dies 76 in the slots 78 of the die lock 71. The die lock 71 includes the two pieces 72, 73, which are coupled together via fasteners 123. The dies 76 include vertical grooves or extensions 74 (e.g., teeth), which interface with the saver sub 44 and the quill 42. For example, the extensions 74 (e.g., teeth) may bite into the saver sub 44 and the quill 42 on either side of the threaded connection 70 after the fasteners 123 (or other coupling device or means) couple the two pieces 72, 73 of the die 71 together. Alternatively, the two pieces 72, 73 may be held together by the two pieces 94, 96 of the secondary retention device 45 being fastened together around the two pieces 72, 73. Accordingly, rotation of the quill 42 transfers torque through the die lock 71 to the saver sub 44 for turning the saver sub 44.

Disposed radially outward from the die lock 71 and extending circumferentially 98 (e.g., 360 degrees circumferentially 98) around the die lock 71 is the secondary retention device 45. The secondary retention device 45 in the illustrated embodiment includes the two pieces 94, 96, each extending 180 degrees circumferentially 98 around the die lock 71, where the two pieces 94, 96 are coupled together around the die lock 71 and, thus, the threaded connection 70 between the quill 42 and the saver sub 44, via the fasteners 124, as previously described, which extend through aligned openings of the first piece 94 and the second piece 96 of the secondary retention device 45. The secondary retention device 45 is configured to serve as a secondary retention device of the saver sub 44 and the rest of the drill string 28 (not shown) or tubular 38 (not shown) below the threaded connection 70 in the event the threaded connection 70 fails, as previously described. The secondary retention device 45 in the illustrated embodiment also includes the vent 100, as previously described, for enabling the mud 107 to flow through the threaded connection 70 after the threaded connection 70 fails and escaping to the area 106 external to the secondary retention device 45.

Figure 6:
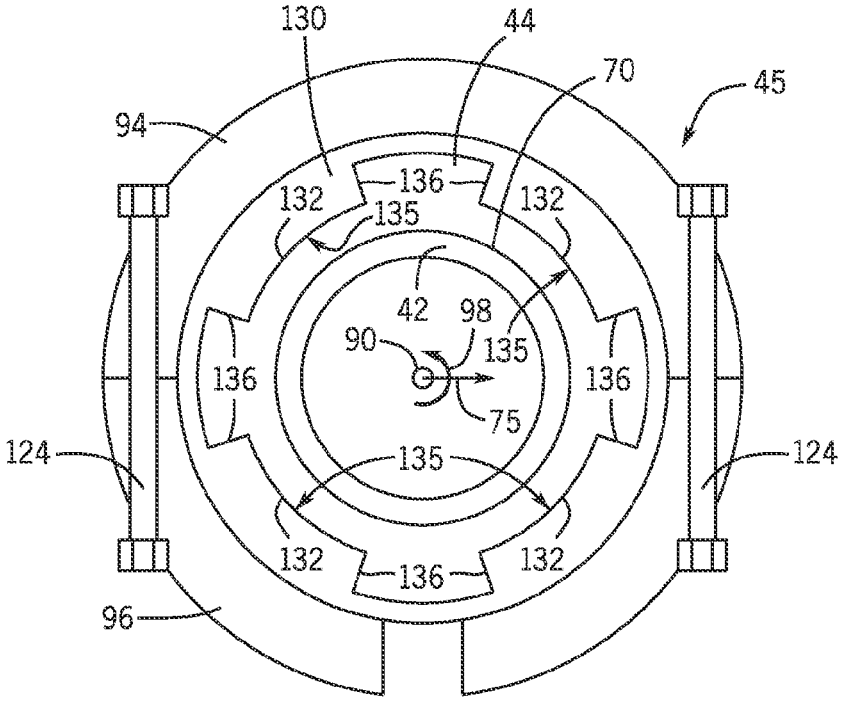
FIG. 6 is a cross-sectional top view of a threaded connection and a retaining device with a spline lock, in accordance with present embodiments.

It should be noted that, in some embodiments, a spline lock 130 may be utilized instead of the die lock 71. For example, a cross-sectional top view of an embodiment of the secondary retention device and the spline lock 130 is shown in FIG. 6. In the illustrated embodiment, the spline lock 130 is a single component configured to slide into place over the threaded connection 70. The spline lock 130 includes four stepped splines 132, where the splines 132 are evenly spaced about the spline lock 130 in circumferential direction 98 (e.g., 90 degrees away from eachother). Each of the splines 132 may be configured to slide into corresponding indentions 135 in the saver sub 44 and the quill 42. Thus, as the quill 42 rotates, sides 136 of each of the splines 132 may engage with the indentions 135 of the rotating quill 42 and the indentions 135 of the saver sub 44. The torque may thus be transferred from the indentions 135 of the quill 42, to the sides 136 of the splines 132 of the spline lock 130, to the indentions 135 of the saver sub 44. In such an embodiment, the secondary retention device 45 may be a separate component and may fit around the spline lock 130 as two pieces, as previously described. The secondary retention device 45 may slackingly engage with the quill 42 and the saver sub 44 on either side of the threaded connection 70, such that the secondary retention device 45 does not bear any load until the threaded connection 70 fails. If the threaded connection 70 fails, the saver sub 44 to will separate from the quill 42 away from the threaded connection 70, causing the secondary retention device 45 to engage with both the saver sub 44 and the quill 42. Thus, the secondary retention device 45 blocks the saver sub 44 from separating from the quill 42 any further.

Figure 7:
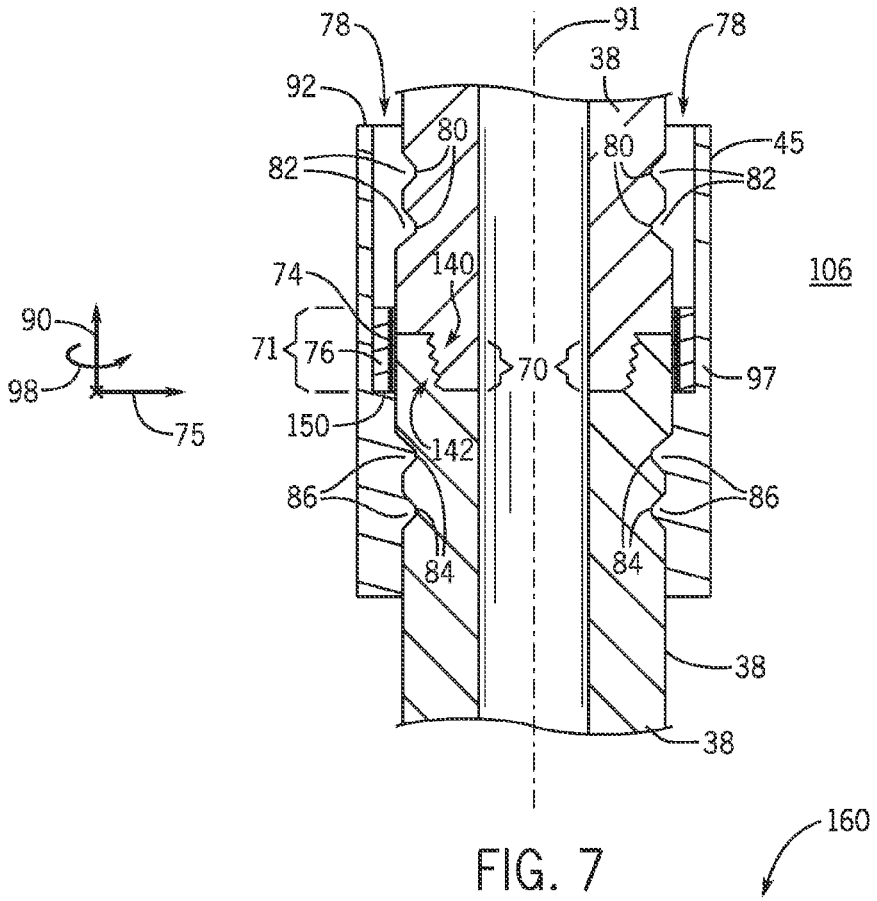
FIG. 7 is a cross-sectional side view of a threaded connection and retaining device of two axially adjacent sections of tubular in accordance with present embodiments.

The secondary retention device 45 may be used for secondary retention of two other components of the drilling rig 10 other than the quill 42 and the saver sub 44. For example, FIG. 7 is an illustration of an embodiment of the secondary retention device 45 disposed around two sections of axially 90 adjacent sections of tubular 38 of the drill string 28. In the illustrated embodiment, the top tubular 38 includes a male thread 140 and the bottom tubular 38 includes a female thread 142, although the configuration may be reversed in another embodiment.

The secondary retention device 45 in the illustrated embodiment includes an integral die lock 71. In other words, the die lock 71 is a part (e.g., a portion) of the secondary retention device 45. Thus, the slots 78 extend to the top 92 of the secondary retention device 45, such that the dies 76 may be inserted through the slots 78 and slid downward through the slots 78 until the dies 76 contact an inner ledge 150 of the secondary retention device 45 (e.g., the die lock portion 71 of the secondary retention device 45). The dies 76 may generally be inserted before disposing the secondary retention device 45 about the threaded connection 70. Once the secondary retention device 45 is secured about the threaded connection 70 via, for example, fasteners, the vertical grooves or extensions 74 of the dies 76 interface with (e.g., bite into) the top tubular 38 and the bottom tubular 38, such that torque may be transferred through the secondary retention device 45 (e.g., through the vertical grooves or extensions 74 of the dies 76 of the die lock 71 portion of the secondary retention device 45) from the top tubular 38 to the bottom tubular 38.

Further, the secondary retention device 45 includes the upper extensions 82 and the lower extensions 86 for interfacing with the grooves 80 of the upper tubular 38 and the grooves 84 of the lower tubular 38, respectively. The upper extensions 82 are only partially visible, as some clearance is needed for fitting the dies 76 into the two shown slots 78 of the secondary retention device 45, such that the dies 76 may slide downwardly beyond the upper extensions 82. In other words, the upper extensions 82 may have circumferential breaks proximate the slots 78, such that the dies 76 may slide into the slots 74. As previously described, when the threaded connection between the upper tubular 38 and lower tubular 38 fails, the secondary retention device 45 may serve as a secondary retention device and bear the axial load of the drill string 38 below the threaded connection 70, such that the drill string 28 and the lower tubular 38 of the drill string 28 do not fall away from the threaded connection 70, for example, into the well 30. Additionally, the secondary retention device 45 may not include a mud vent, as previously described, since the slots 78 extend through the secondary retention device 45 longitudinally 90 up to and slightly beyond the threaded connection 70, and mud may escape through the threaded connection 70 from inside of the secondary retention device 45 to the area 106 external to the secondary retention device 45 through the slots 78.

Figure 8:
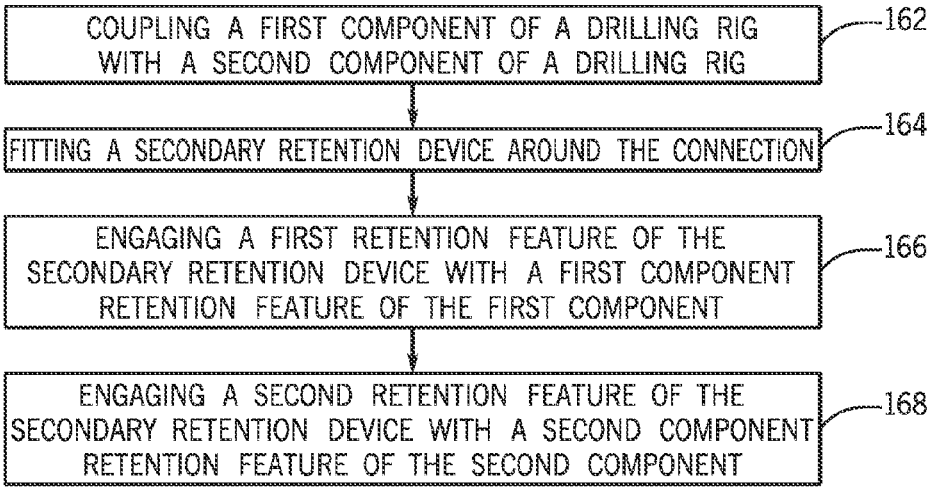
FIG. 8 is a process flow diagram of a method of connecting two components of a drilling rig in accordance with present techniques.

Turning now to FIG. 8, a process flow diagram is shown illustrating a method 160 of secondary retention of components of the drilling rig 10. The method 160 includes coupling a first component of a drilling rig with a second component of the drilling rig via a connection (e.g., threaded connection) (block 162). For example, the first component may include a male thread that engages with a female thread of the second component. The method 160 also includes fitting a secondary retention device around the connection between the first and second components (block 164). For example, the secondary retention device may include two pieces, where each piece extends 180 degrees around the connection, and the two pieces are coupled together via a fastener extending through aligned openings of both pieces. The method 160 also includes engaging a first retention feature of the secondary retention device with a first component retention feature of the first component above the connection (block 166), and engaging a second retention feature of the secondary retention device with a second component retention feature of the second component below the connection (block 168). For example, the retention features may be extensions that fit into the component retention features (e.g., grooves) of the first and second components. Alternatively, the retention features may be grooves, and extensions of the first and second components (e.g., the component retention features) fit into the grooves of the secondary retention device. Thus, in the event the connection fails, the two components are held together via the secondary retention device. The method 160 may optionally include engaging vertical extensions or grooves of an inner surface of the secondary retention device (or vertical extensions/grooves of dies disposed in slots of the secondary retention device or in slots of a die lock sandwiched between the secondary retention device and the connection) with vertical grooves of the first and second components, such that torque is transferred from the first component to the second component via the secondary retention device or the die lock disposed between the secondary retention device and the connection. Further, it should be noted that a spline lock may be used instead of the die lock, where the spline lock is a separate component that fits between the secondary retention device and the threaded connection and engages with both the first and second components (as shown in FIG. 6).

While only certain features have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for retention of components of a drilling rig, the system comprising:

a first drilling component comprising a first annular groove or ridge;

a second drilling component comprising a second annular groove or ridge;

a secondary retention device, wherein the first drilling component is coupled to the second drilling component and the secondary retention device engages with the first annular groove or ridge of the first drilling component and the second annular groove or ridge of the second drilling component; and a torque transfer device, wherein the torque transfer device interfaces with the first drilling component and the second drilling component such that the torque transfer device transfers torque between the first drilling component and the second drilling component via the interface of the torque transfer device with the first and second drilling components, and wherein the torque transfer device is disposed radially between the secondary retention device and the first and second drilling components.

2. The system of claim 1, wherein the first drilling component comprises a quill and the second drilling component comprises a saver sub.

3. The system of claim 1, wherein the first drilling component is coupled to the second drilling component via a threaded connection disposed axially between the first annular groove or ridge of the first drilling component and the second annular groove or ridge of the second drilling component.

4. The system of claim 3, wherein the secondary retention device slackingly engages in an axial direction with the first annular groove or ridge and with the second annular groove or ridge while the first drilling component is coupled to the second drilling component via the threaded connection, such that the secondary retention device does not bear a substantial axial load during normal operating conditions.

5. The system of claim 1, wherein the torque transfer device comprises a die lock.

6. The system of claim 5, wherein the first drilling component comprises a first cylindrical portion and the second drilling component comprises a second cylindrical portion, wherein the secondary retention device fits over and substantially surrounds the first cylindrical portion and the second cylindrical portion.

7. The system of claim 5, wherein the die lock and the secondary retention device are a single integrated component.

8. The system of claim 1, wherein the torque transfer device comprises a spline lock configured to fit over a connection between the first drilling component and the second drilling component and between the connection and the secondary retention device, wherein the spline lock comprises vertical splines configured to engage with indentions in both the first and second drilling components such that the spline lock transfers torque from the first drilling component to the second drilling component.

9. The system of claim 1, wherein the secondary retention device comprises a vent configured to enable mud to escape from a space between the secondary retention device and the first and second drilling components to an area external to the secondary retention device.

10. The system of claim 1, wherein the first annular groove or ridge comprises a lower face extending perpendicular to a longitudinal axis of the first drilling component, and wherein the second annular groove or ridge comprises an upper face extending parallel with, and facing, the lower face of the first annular groove or extension.

11. A secondary retention device for use in a drilling rig, comprising:

a first axial retention feature;

a second axial retention feature; and a body extending between the first axial retention feature and the second axial retention feature, wherein the first axial retention feature of the secondary retention device engages with a first annular groove or ridge of a first drilling component, wherein the second axial retention feature of the secondary retention device engages with a second annular groove or ridge of a second drilling component axially adjacent to the first drilling component, wherein the body of the secondary retention device fits over and around a threaded connection between the first drilling component and the second drilling component, wherein a torque transfer device is disposed radially between the body of the secondary retention device and the threaded connection of the first and second drilling components, and wherein vertical features of the torque transfer device engage with the first drilling component and the second drilling component such that the torque transfer device transfers torque between the first drilling component and the second drilling component.

12. The secondary retention device of claim 11, wherein the first drilling component is a substantially cylindrical quill and the second drilling component is a substantially cylindrical saver sub.

13. The secondary retention device of claim 11, wherein the first and second axial retention features of the secondary retention device slackingly engage in an axial direction with the first and second drilling components, respectively, such that the secondary retention device does not bear a substantial axial load during normal operating conditions.

14. A method of secondary retention of two drilling components on a drilling rig, the method comprising:

coupling a first drilling component of the drilling rig with a second drilling component of the drilling rig via a threaded connection;

fitting a torque transfer device circumferentially around the threaded connection;

fitting a retaining device circumferentially around the torque transfer device and the threaded connection;

engaging a first device feature of the retaining device with a first groove or ridge of the first drilling component above the threaded connection;

engaging a second device feature of the retaining device with a second groove or ridge of the second drilling component below the threaded connection; and engaging vertical features of the torque transfer device with the first and second drilling components such that torque is transferred from the first drilling component to the second drilling component via the vertical features.

15. The method of claim 14, wherein the torque transfer device comprises a spline lock and the vertical features of the torque transfer device comprise vertical splines.

16. The method of claim 14, wherein the first and second device features are ridges or grooves.

17. The method of claim 14, wherein the torque transfer device comprises a die lock and the vertical features of the torque transfer device comprise vertical teeth of dies.

* * * * *